United States Patent [19]

Klotzbücher et al.

[11] 4,212,451

[45] Jul. 15, 1980

[54] INSTALLATION FOR THE PRODUCTION OF CONTINUOUSLY CAST BILLETS

[75] Inventors: Hansjöng Klotzbücher, Muri; Erwin Kolb, Illnau; Bernhard Hilge, Adliswil, all of Switzerland

[73] Assignee: Swiss Aluminium Ltd., Chippis, Switzerland

[21] Appl. No.: 893,802

[22] Filed: Apr. 5, 1978

Related U.S. Application Data

[62] Division of Ser. No. 691,729, Jun. 1, 1976.

[30] Foreign Application Priority Data

Jun. 6, 1975 [CH] Switzerland ..... 7342/75

[51] Int. Cl.[2] ..... B22D 11/12; C22D 1/04; C22D 1/06

[52] U.S. Cl. ..... 266/50; 148/155; 266/114; 266/127

[58] Field of Search ..... 266/93, 102, 103, 105, 266/251, 259, 50, 114, 121, 127; 164/270, 442, 263, 82; 148/11.5 A, 11.5 M, 155, 157, 143, 3, 12.7 A

[56] References Cited

U.S. PATENT DOCUMENTS

| | | | |
|---|---|---|---|
| 3,304,210 | 2/1967 | Löfström | 148/155 |
| 3,464,481 | 9/1969 | Hartzell, Jr. | 164/263 |
| 3,908,746 | 9/1975 | Follrath et al. | 164/82 |
| 3,953,247 | 4/1976 | Elhaus et al. | 148/157 |
| 4,042,227 | 8/1977 | Niehaus et al. | 266/93 |

FOREIGN PATENT DOCUMENTS

| | | | |
|---|---|---|---|
| 332140 | 3/1972 | U.S.S.R. | 148/11.5 A |
| 397263 | 2/1974 | U.S.S.R. | 164/263 |

OTHER PUBLICATIONS

"Industrial Furnaces for Thermal Processing of Non-Ferrous Metals," *Industrial Heating*, Oct. 1974, pp. 53–54.

"Thermal Processing of Wide Aluminum Plate at Alcoa's Davenport Works," *Industrial Heating*, Apr. 1974, pp. 36–38 & May 1974, pp. 38–40, 42, 44.

*Primary Examiner*—L. Dewayne Rutledge
*Assistant Examiner*—Peter K. Skiff
*Attorney, Agent, or Firm*—Bachman and LaPointe

[57] ABSTRACT

A process and installation for carrying out the process are disclosed wherein aluminium or magnesium alloys are continuously cast as extrusion billets with a high degree of automation. The billets are continuously cast, cut into lengths while warm and subjected to continuous or semi-continuous treatment. The installation allows for considerable savings in handling between stages, requires less space than conventional installations and allows for high consistency in product quality.

10 Claims, 4 Drawing Figures

INSTALLATION FOR THE PRODUCTION OF CONTINUOUSLY CAST BILLETS

This is a division, of application Ser. No. 691,729, filed June 1, 1976.

BACKGROUND OF THE INVENTION

The present invention is drawn to equipment for the production of continuously cast billets, in particular extrusion billets of aluminium or magnesium alloys.

Billets of aluminium or magnesium alloys which hereinafter are simply referred to as "billets", which are produced by continuous casting must, after casting, be subjected to a heat treatment (e.g. heating up, holding at temperature and cooling) in order to heterogenize and/or homogenize. Therefore the production process includes, in addition to the continuous casting itself, the subsequent heat treatment, possibly the cutting to a predetermined length and preparation for dispatch.

In known processes it is necessary to have extensive handling in terms of transporting and storing between the various individual stages of the process i.e., between continuous casting, subdivision of the billets into lengths which are suitable for heat treatment, cutting to the desired final length with the saw, stacking and packing. The known installations for billet production require therefore a large amount of space. In addition, the known processes also require a large labor force for transporting the billets from one production stage to another and for storing the billets between stages.

SUMMARY OF THE INVENTION

The object of the present invention is to produce an installation in which it is possible to manufacture continuously cast billets, in particular billets of aluminium or magnesium alloys wherein extensive handling of the billets is avoided and production is carried out in a considerably reduced working space than heretofore known.

These objects are achieved by way of the present invention wherein liquid metal is continuously cast as a billet, the billet is mechanically led off at a speed corresponding to the casting speed, cut to lengths and subjected to a continuous or semi-continuous heat treatment.

The metal is preferably cast horizontally and continuously wherein the cast billet mover at casting speed and can be cut to length while warm.

An installation for the production of continuously cast billets in accordance with the present invention includes a horizontal continuous casting machine which can be provided with one or more i.e. with a single or a plurality of parallel molds, a conveyance facility such as a track of rollers or the like leading from the mold, a device for cutting the billet to length which operates in conjunction with the billet conveyor track and finally, also working in conjunction with the billet conveyor track, a heat treatment facility for the continuous heat treatment of the billets.

In a preferred embodiment of this installation, the billet cutting facility, which is positioned on the billet conveyance system, can be moved along the conveyor track at a speed which corresponds to the rate of production of the billet emerging from the continuous casting machine. With the installation of the present invention it is now possible to produce heat-treated, continuously-cast billets in a continuous manner.

The main advantage of the present invention is that the uniformity of product quality is improved because the material is always treated under conditions which are practically uniform. This has a positive influence on the uniformity and quality of metallurgical structure produced.

If the heat treatment consists of only one high temperature soak and cooling the continuously cast billets coming from the caster need only to be cooled to the required heat-treatment temperature. In this case, an additional advantage results in that there is a saving of energy which could not be realised in any way in the known processes where the billet is cooled to the ambient temperature.

In the case of highly alloyed alloys the desired structure can be achieved only if the heat treatment is preceded by cooling to a relatively low temperature such as 300° C., but not lower than 200° C. The heat treatment includes heating up as well as soaking at a high temperature.

An improvement in metal quality is achieved in both cases in that it is not necessary to cool to room temperature.

Furthermore, the handling between stages, the storing of the billets, and the need for personnel to perform these tasks is all saved. The actual amount of space required by the installation of the present invention is considerably smaller than that needed by the installations used heretofore. Finally, the throughput time for the material is shortened and the danger of damage to it is reduced.

As a rule, the heat treatment can span different lengths of time. This factor is taken into consideration in a preferred embodiment of the installation of the present invention in which the heat treatment stage comprises at least one pre-heating furnace and a separate holding furnace. The pre-heating furnace includes a transporting facility which can be driven intermittently or continuously and the holding furnace has an independent billet conveyance facility which can be driven continuously. There can be provided between the pre-heating furnace and the holding furnace a conveyance facility which is designed to transport the billets from the conveyance track or from a reserve magazine adjacent to this to the pre-heating furnace and, in addition, from the pre-heating furnace to the holding furnace.

In a simpler embodiment of the present invention, the heat treating stage comprises a furnace which can be operated with continuous throughput and has a preheating zone and a soaking zone at the desired temperatures and has a facility for transporting the billets between these two zones. The heat-treating stage is indeed simpler but requires very accurate control of the heat supplied in the pre-heating zone so that at the end of that zone the desired heat treatment temperature is reached. As the heat treatment of individual billets can be regulated only by the amount of heat supplied and not by variation of the rate of transport or length of cycle, the flexibility of this last mentioned heat treatment facility with only one furnace is not as great as when separate pre-heating and holding furnaces are provided.

BRIEF DESCRIPTION OF THE DRAWINGS

The installation in accordance with the present invention is explained in greater detail in the following with the help of schematic drawings of exemplified embodiments wherein.

DETAILED DESCRIPTION

Figure 1:
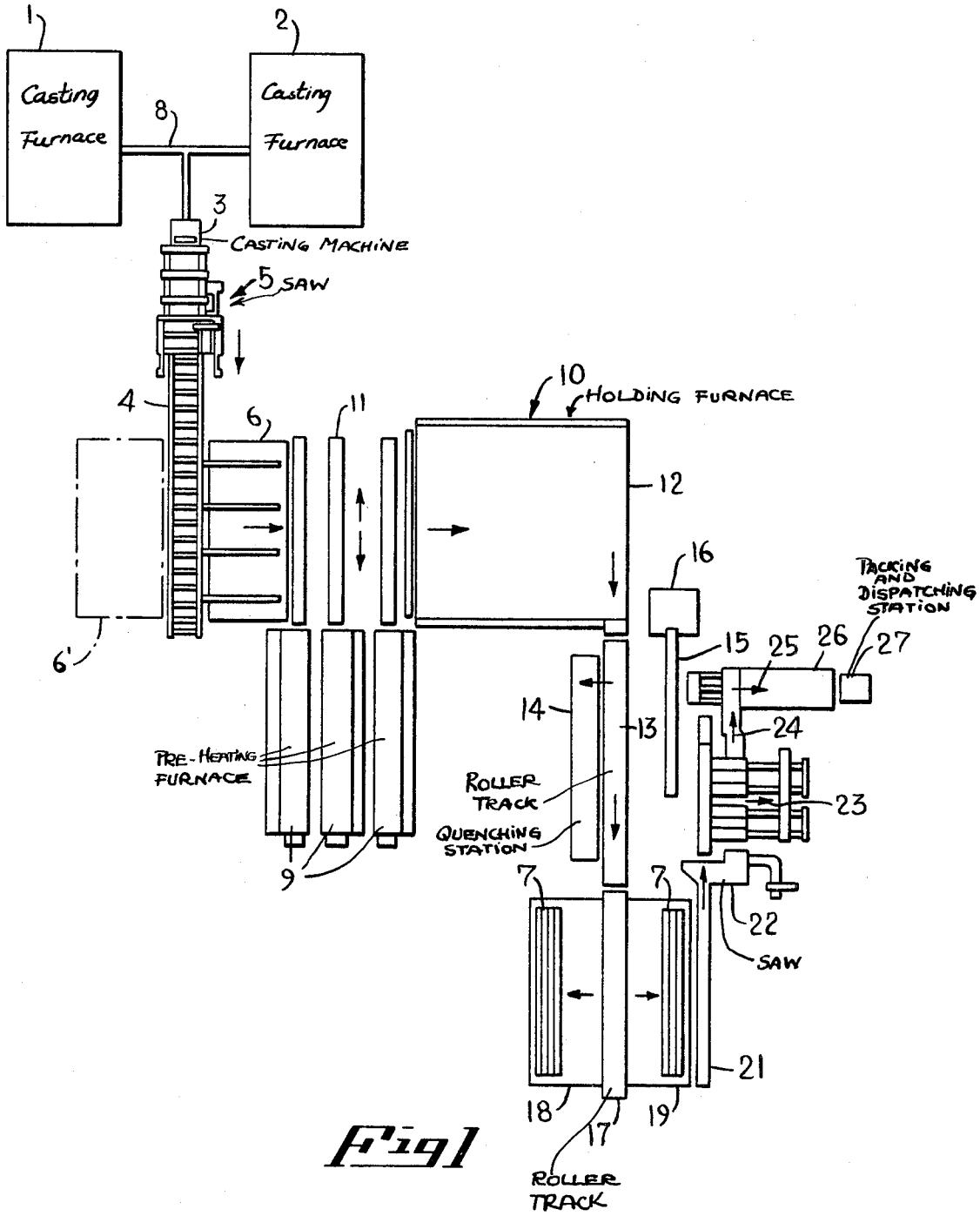
FIG. 1 is a plan view of an installation for the production of extrusion billets.

In the schematic plan view of FIG. 1, two casting furnaces in which the melt is prepared are designated 1 and 2. The two furnaces 1, 2 feed alternately, via a casting channel 8, a horizontal casting machine which as a whole is designated here by the number 3. A roller track 4 connects up with the casting machine 3 in the direction of casting. Provided at the side of the track 4 is a "flying saw" 5 which can move with the billet at the casting speed and is reversible, whereby the movement in reverse can take place at a faster rate.

At the side of the roller track 4, at the end away from the casting machine 3, is a feeding magazine 6 which automatically removes from the track 4 the billets which have been cut by the saw 5. A similar magazine 6', which is shown in FIG. 1 in broken lines, can be provided for additional charging to or discharging from the production line. For example, the magazine 6' is used for temporary storage of billets if the heat treatment station joined on to the feeding magazine 6 is not functioning because of maintainance or repair work being performed to it.

The heat-treatment station comprises three pre-heating furnaces 9 and one holding furnace 10. The pre-heating furnaces 9 are periodically fed with individual billets by means of conveyance facility 11 provided between them and the feeding station 6. The length of the pre-heating furnaces 9 is such that one billet of the largest size (length approx. 7.5 m) fits into each furnace 9. In the pre-heating furnaces there are provided rows of burners the flames of which impinge directly onto the stationary billets and thus effect rapid heating of the billets. After reaching the desired temperature the billets are removed from the pre-heating furnaces by means of the reversible conveyance facility 11 and transferred to the holding furnace 10 the entrance of which is perpendicular to the entrance of the pre-heating furnaces. This holding furnace 10 has its own transporting device on which the billets are transported sideways through the furnace 10 at a rate which is sufficient to allow the desired heat-treatment time in the furnace.

The time required for holding at heat-treatment temperature is longer than the pre-heating time. Depending on the desired production capacity, one or more pre-heating furnaces are provided, so that the heat treatment can be carried out continuously. At the exit 12 of the holding furnace 10 the heat-treated billets are transferred to a roller track 13 and from there to a cooling or quenching facility 14.

From the quenching stage 14 the quenched billets are again loaded onto the track 13 which transfers them to another track 17. The billets 7 can be removed to a table 18 positioned at the left of the track 17 as shown in FIG. 1, and this without being cut to a different length.

The billets 7 are led from a storage table 19, at the right of the track 17 as shown in FIG. 1, by means of a conveyance track 21 to a saw 22 where the billets 7 are cut to the desired final length. The billets 7 which have been cut to length are either discharged in the direction of arrow 23 or led off in the direction of arrows 24 and 25 to a facility 26 for stacking the billets automatically. From there the billets are let off in batches to a packing and dispatch station 27.

On the other side of the track 21 there is provided a conveyor belt for scrap. At the end of the conveyor belt there is a container 16 to collect the scrap.

Figure 2:
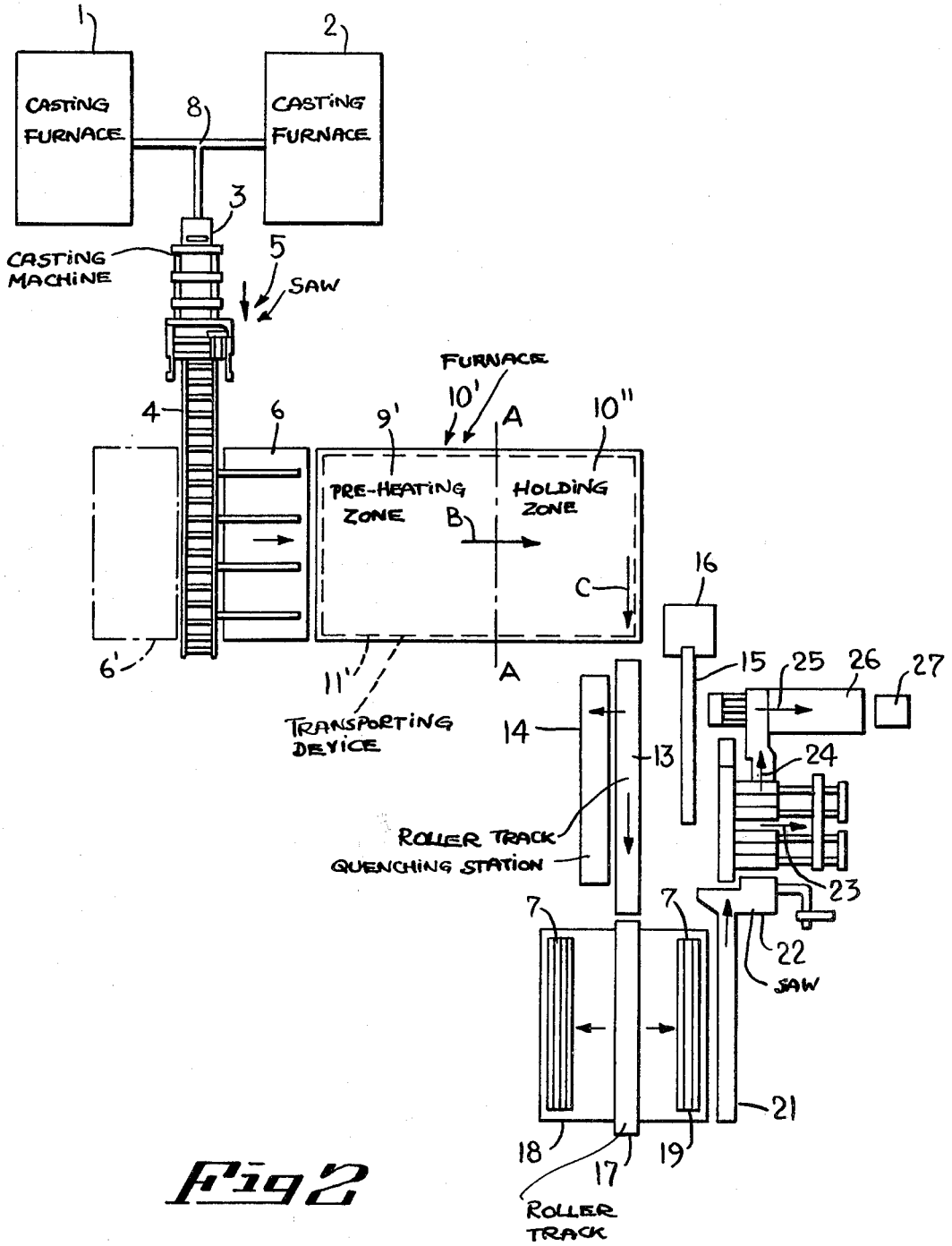
FIG. 2 is a plan view of a modified installation in accordance with the invention.

The embodiment shown in FIG. 2 differs from that in FIG. 1 only in that the pre-heating furnaces 9 and the holding furnace 10 are provided in a single furnace 10' which includes a pre-heating zone 9' and a holding zone 10" separated in FIG. 2 by a broken line A—A. The billets are passed from the feeding device by a transporting facility 11' which moves continuously through this furnace. The temperature in the fire-heating zone 9' can be so adjusted that at its end i.e. at the beginning of the soaking zone the billets have reached the soaking temperature. The transporting device 11' is indicated in FIG. 2 by a rectangle drawn in broken lines. It can comprise a double strand conveyor chain with supports for the billets 7 running transverse to the direction of movement (arrow B). At the exit from the furnace 10' the billets 7, as in the embodiment shown in FIG. 1, are transferred transverse to the direction of movement B of the device 11', in the direction of arrow C on to the roller track 13, by means of conventional facilities which are not shown here.

Figure 3:
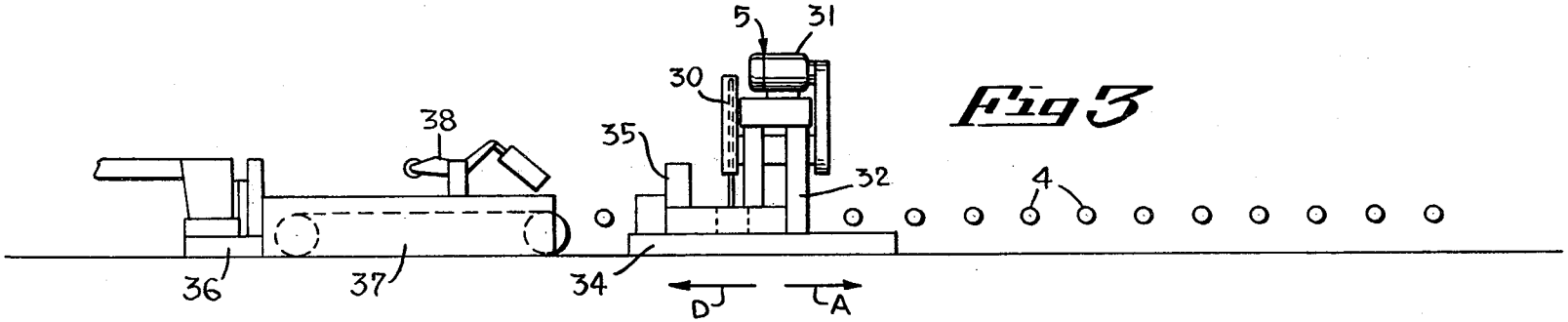
FIGS. 3, 4 are, respectively, an end view and a plan view of a "flying saw" which is used in the installation according to the invention and shown here in larger scale than in the FIGS. 1 and 2.
Figure 4:
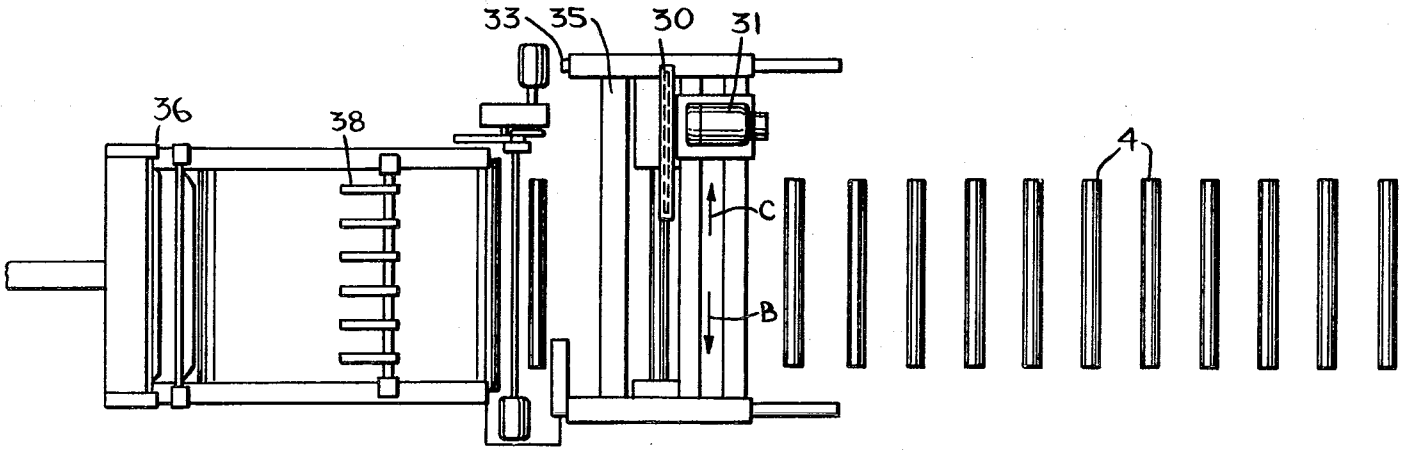

The "flying saw" shown in FIGS. 3 and 4 which can be moved at the casting speed along the track 4, includes a circular saw blade 30, which can be moved together with its power drive 31, transverse to the track length by means of a feed drive which is not shown in greater detail here. The arrangement of the saw blade 30, its drive 31 and the feed drive is indicated here as a whole by the vehicle unit 32 which can be moved in the direction of movement of track 4 on the rails 33, 34 provided at both sides of the track 4. Incorporated in the unit 32 is a clamping facility with a clamping beam 35 which holds the billets firmly during the sawing operation.

On the left of FIGS. 3 and 4 at the mold system 36 one can see a conveyor belt 37 with a mechanism 38 for pressing the billet on to the upper part of the conveyor belt 37. The flying saw works as follows: First the unit 32 is accelerated up to the casting speed in the direction of the arrow A. Next the billets are clamped by the beam 35, which is mounted on the unit 32, moves together with the unit 32. The saw is now made to move forward (arrow B in FIG. 4) so that the saw blade 30 cuts through the billet while the billet is moving forward at the casting speed. The saw blade is then moved in the reverse direction (arrow C in FIG. 4) so that it returns to the starting position again. The beam 35 is unclamped and the saw unit 32 moves back quickly to its initial position.

In specific applications, the continuously cast billets can be used in their full length wherein they are taken directly from the magazine table 18.

The billets can also be used straight away as beams, busbars or the like without extruding them.

It is also conceivable that there are applications for which the continuously cast billets are subjected to the subsequent thickness reduction by rolling instead of extrusion.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What we claim is:

1. An installation, for use in producing continuously cast billets, of alloys of aluminum or magnesium, comprising, in combination, a horizontal continuous casting machine operable for casting the billets, a horizontal conveyor connected up to said casting machine for receiving the cast billets from said machine while warm, a movable cutting device operable to move synchronously with said conveyor for cutting the billets as they are transported while warm by said conveyor, a heat treating unit disposed adjacent said conveyor and being operable to receive said cut warm billets from the conveyor and to heat treat them thereafter, a reserve magazine provided between said heat treating unit and the end of the conveyor track remote from the casting machine, a cooling unit adjacent and downstream of said heat treating unit for receiving the heat treated billets for controlled cooling thereof, a cutting device adjacent and downstream of said cooling unit for cutting the heat treated billets to the desired final length, and providing at the end of the production line an automatic stacking and packing device.

2. An installation, for use in producing continuously cast billets, of alloys of aluminum or magnesium, comprising, in combination, a horizontal continuous casting machine operable for casting the billets, a horizontal conveyor connected up to said casting machine for receiving the cast billets from said machine while warm, a movable cutting device operable to move synchronously with said conveyor for cutting the billets as they are transported while warm by said conveyor, a heat treating unit disposed adjacent said conveyor and being operable to receive said cut warm billets from the conveyor and to heat treat them thereafter, a reserve magazine provided between said heat treating unit and the end of the conveyor track remote from the casting machine, and a stacking and packing unit downstream of said heat treating unit operable to receive said billets off the end of the production line and stack and pack them.

3. An installation according to claim 2, in which the cutting device is a flying saw.

4. An installation according to claim 2, in which a device is provided for the continuous feed of molten metal to the casting machine.

5. An installation according to claim 2, in which the heat treatment unit comprises at least one pre-heating furnace and a separate holding furnace.

6. An installation according to claim 5, in which the pre-heating furnace includes a billet conveyance facility which can be driven intermittently or continuously though the movement can be interrupted, and the holding furnace includes an independent billet conveyance facility which can be operated continuously.

7. An installation according to claims 5, or 6, in which there is provided a conveyance device for transporting the billets from said conveyor track or from said adjacent reserve magazine to the pre-heating furnace and in addition from the pre-heating furnace to the holding furnace.

8. An installation according to claim 2, in which the heat treating unit comprises a furnace which can be operated in a continuous manner and having a pre-heating zone and a soaking zone and a conveyance facility for transporting the billets through both of these zones.

9. An installation according to claim 2, in which a cooling unit for the controlled cooling of the billets is provided in line after the heat treating unit.

10. An installation according to claim 2, in which a cutting device for cutting the billets to the desired final length is provided in line after the heat treating unit.

* * * * *

UNITED STATES PATENT AND TRADEMARK OFFICE

CERTIFICATE OF CORRECTION

PATENT NO. : 4,212,451

DATED : July 15, 1980

INVENTOR(S) : Hansjorg Klotzbucher, Erwin Kolb & Bernhard Hilge

It is certified that error appears in the above-identified patent and that said Letters Patent are hereby corrected as shown below:

On the Cover Page, lines 8-9, the Assignee should be changed to read as follows:

--Assignee: Prolizenz AG, Chur, Switzerland--.

Column 6, line 30, claim 7, change "said", first occurrence, to --the-- and change "said", second occurrence, to --an--.

Signed and Sealed this

Fourth Day of November 1980

[SEAL]

*Attest:*

SIDNEY A. DIAMOND

*Attesting Officer*

*Commissioner of Patents and Trademarks*